US008258721B2

(12) United States Patent
Meyer

(10) Patent No.: US 8,258,721 B2
(45) Date of Patent: Sep. 4, 2012

(54) REMOTELY CONTROLLABLE TRACK LIGHTING SYSTEM

(75) Inventor: A. Corydon Meyer, Bonita Springs, FL (US)

(73) Assignee: Evolution Lighting, LLC, Miami Lakes, FL (US)

( * ) Notice: Subject to any disclaimer, the term of this patent is extended or adjusted under 35 U.S.C. 154(b) by 562 days.

(21) Appl. No.: 12/363,834

(22) Filed: Feb. 2, 2009

(65) Prior Publication Data

US 2010/0066267 A1 Mar. 18, 2010

Related U.S. Application Data

(60) Provisional application No. 61/097,404, filed on Sep. 16, 2008.

(51) Int. Cl.
*H05B 37/02* (2006.01)
*H05B 39/00* (2006.01)
*F21V 21/34* (2006.01)

(52) U.S. Cl. ..... 315/294; 315/313; 315/149; 315/312; 315/316; 362/576; 362/404; 362/418; 362/147

(58) Field of Classification Search ..... 315/291, 315/294, 149, 313, 308, 312, 316; 340/825.25, 340/825.21, 825.2, 825.22; 362/236, 227, 362/233

See application file for complete search history.

(56) References Cited

U.S. PATENT DOCUMENTS 4,656,398 A 4/1987 Michael et al.
4,688,154 A * 8/1987 Nilssen ..... 362/147
4,822,292 A 4/1989 Thayer et al.
5,072,216 A * 12/1991 Grange ..... 362/233
5,347,431 A * 9/1994 Blackwell et al. ..... 362/11
5,637,964 A 6/1997 Hakkarainen et al.
6,037,721 A 3/2000 Lansing et al.
6,175,201 B1 * 1/2001 Sid ..... 315/312
6,310,440 B1 10/2001 Lansing et al.
6,655,817 B2 12/2003 Devlin et al.
6,667,578 B2 12/2003 Lansing et al.
6,794,830 B2 9/2004 Lansing et al.
7,024,119 B1 4/2006 Mier-Langner et al.
7,027,736 B1 4/2006 Mier-Langner et al.
7,070,293 B2 * 7/2006 Seymour ..... 362/147

(Continued)

FOREIGN PATENT DOCUMENTS

WO 03078894 A 9/2003

*Primary Examiner* — Vibol Tan
(74) *Attorney, Agent, or Firm* — Feldman Gale, P.A.; Michael C. Cesarano

(57) ABSTRACT

A remotely controllable track lighting system includes a track mountable to a support structure, such as a wall or ceiling, with lamps that are supported on the track that are individually controlled by a wireless remote. Each lamp on the track may be set to respectively different intensity levels (e.g., high, mid, low, off) or the user can uniformly control the lamps to be set to the same intensity level. Advantageously, all of the lamps may be set, upon initially turning on the lamps or at another time as desired, to their respective previously set intensity levels. The track system may also be powered via a wall switch where initially turning on the lamps via the wall switch advantageously causes all of the lamps to return to their respective previously set intensity levels or the user can move the wall switch off then on within a short period of time (e.g., 3 seconds) to cause all of the lamps to be set high. Other features and variations also are provided.

8 Claims, 3 Drawing Sheets

U.S. PATENT DOCUMENTS

| | | | | |
|---|---|---|---|---|
| 7,335,523 | B2 | 2/2008 | Liu et al. | |
| 7,355,523 | B2 * | 4/2008 | Sid | 340/9.16 |
| 7,391,297 | B2 | 6/2008 | Cash et al. | |
| 7,507,005 | B1 * | 3/2009 | Mier-Langner | 362/418 |
| 7,764,162 | B2 * | 7/2010 | Cash et al. | 340/3.5 |
| 2001/0000422 | A1 | 4/2001 | Sid | |
| 2003/0107888 | A1 | 6/2003 | Devlin | |
| 2003/0179578 | A1 | 9/2003 | Albert et al. | |
| 2005/0231134 | A1 * | 10/2005 | Sid | 315/294 |
| 2005/0243549 | A1 | 11/2005 | Ruston | |
| 2006/0067089 | A1 * | 3/2006 | Hocquard et al. | 362/576 |
| 2007/0268701 | A1 | 11/2007 | Devlin | |

* cited by examiner

10

REMOTELY CONTROLLABLE TRACK LIGHTING SYSTEM

REFERENCE TO RELATED APPLICATION

This application claims priority to U.S. provisional application No. 61/097,404, filed Sep. 16, 2008, the disclosure of which is incorporated herein by reference.

FIELD OF THE INVENTION

The present invention relates to a remotely controllable track lighting system providing wireless remote control of individual lamps within the track lighting system through a central main control unit.

BACKGROUND OF THE INVENTION

Track lighting systems are very popular and easy to install. Generally, they include multiple lamps supported on a track that itself is mounted to a support structure such as a ceiling or a wall. The lamps may be fixed or positioned at any point along the full length of the track, and the angle of each lamp also may be adjusted in either case. The lamps are powered from a single power supply whose power is distributed by conductors running along the inner surfaces of the track. Lamps and tracks are available in a variety of decorative styles, which make track lighting systems ideal for use in various environments, including the home, the office or in a professional gallery.

Although existing track lighting systems provide some flexibility (e.g. lamps can be rotated), they are still limited in many respects. Thus, there still exists a need for various improvements to existing track lighting systems.

SUMMARY OF THE INVENTION

In view of the foregoing, a track lighting system is provided with various features and capabilities not currently available in existing track lighting systems. More particularly, in accordance with the present invention, a track lighting system is comprised of a track to be mounted to a support structure, such as a wall or ceiling. The track supports a multiple number of lamps, where each of the lamps are disposed along different parts of the track. The system includes a wireless remote with buttons to allow user control of individual lamps of the track lighting system. The system also includes a controller that receives signals wirelessly transmitted by the wireless remote and controls the lamps to be set to respective intensity levels based on which button or buttons are depressed on the wireless remote by the user.

As an aspect of the present invention, the wireless remote includes buttons dedicated to each of the lamps to enable user control of an individual lamp on the track.

As a feature of this aspect, repeatedly depressing a dedicated button causes the associated lamp to cycle through different intensity levels.

As another aspect of the present invention, the controller includes memory for storing data that identifies the previously set intensity level of each of the lamps. The wireless remote includes a "pre-set level" button that causes the controller of the track system to set all of the lamps to their respective previously set intensity levels.

As an optional feature of the present invention, depressing the pre-set level button multiple times in succession causes all of the lamps to be set to a maximum intensity level.

As an optional variation, depressing the pre-set level button sets all of the lamps to their respective previously set intensity levels if their currents levels are not already at their pre-set levels, otherwise all of the lamps are turned off.

As a further aspect of the present invention, the wireless remote includes a "uniform control" button, and depressing this button causes the controller to set all of the lamps to a uniform intensity level. Depressing the uniform control button multiple times causes all of the lamps to cycle through different intensity levels.

As an additional aspect of the present invention, the track light system may be powered via a switch, such as a wall switch, wherein moving the switch from the off position to the on position causes each of the lamps on the track to be set to their respective previously set intensity level. As an optional feature, moving the switch from the on position, then to the off position, and back to the on position, within a short period of time causes all of the lamps to be set to the maximum intensity level.

As yet another aspect of the present invention, the controller includes multiple power outputs for providing power to each of the lamps on the track via respective power lines. Optionally, the lamps can be moved to different positions on the track and the power lines are sufficiently long to allow the lamps to be placed at such different positions. In another version, the lamps are fixed on the tracks.

As yet a further aspect of the present invention, the wireless remote optionally may include memory for storing data that identifies the previously set intensity levels of each of the lamps. The signal transmitted by the wireless remote to the track controller then includes information that identifies the intensity level of one of the lamps, multiple lamps, or all of the lamps.

As a further aspect of the present invention, the track lighting system may include a second track (separate from the first track) with a second set of lamps thereon. The wireless remote then is able to control the lamps on either or both of the tracks.

In accordance with another embodiment of the present invention, the track lighting system includes a track that has track segments with power conductors electrically isolated from one another. Each of the lamps is supported on a select one of the track segments and power is supplied to each lamp through the respective power conductor of the track segment supporting that lamp. The wireless remote controls the power level of each of the track segments. Then, if two lamps are supported on the same track segment, varying the power level of the power conductor of that track segment causes the intensity level of the two lamps to change. Each of the above-mentioned aspects, feature and variations also may be applied to this embodiment.

In addition to the foregoing, other features, objects and advantages of the present invention will become apparent from the following description and appended claims.

BRIEF DESCRIPTION OF THE DRAWINGS

The following detailed description, given by way of example and not intended to limit the present invention solely thereto, will best be appreciated in conjunction with the accompanying drawings, wherein like reference numerals denote like elements and parts, in which.

DETAILED DESCRIPTION OF THE INVENTION

The present invention relates to improvements in track lighting. The remotely controllable track lighting system (or, for convenience, "track lighting system") of the present invention entails track lighting that is controllable in various novel manners by a wireless remote control and a central controller with or without a wall-mounted switch. As discussed in detail below, the track lighting system of the present invention is designed to enable the individual lamps (or "lights") within the system to be individually controlled so that different lamps can be set to different intensity levels and, further, the lamps can be quickly and easily set to previously set intensity levels. Other features of the track lighting system also are described.

Figure 1:
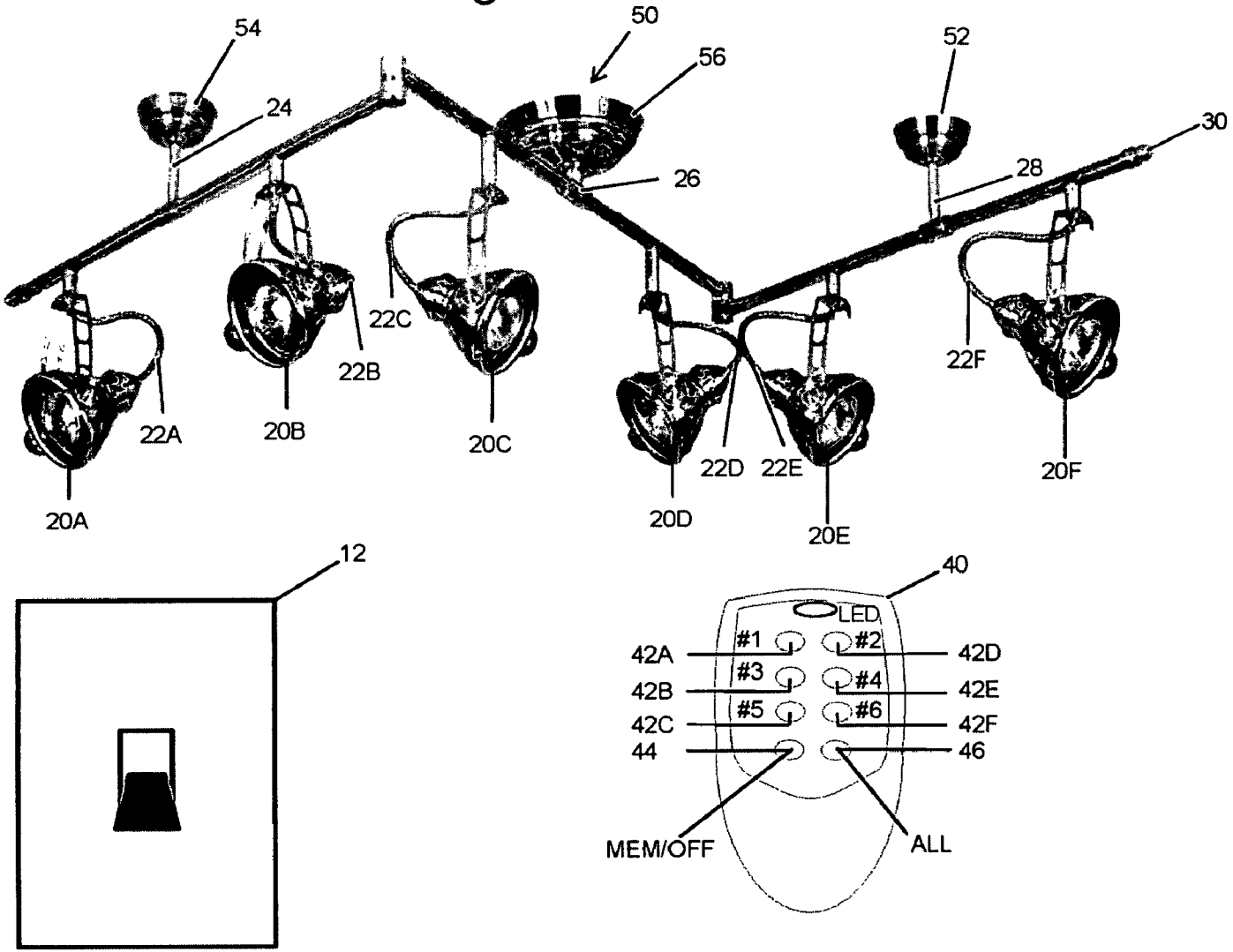
FIG. 1 is a schematic illustration of the remotely controllable track lighting system of the present invention.

FIG. 1 of the accompanying drawings schematically illustrates the remotely controllable track lighting system 10 ("track lighting system 10" or "system 10") of the present invention. As shown, track lighting system 10 includes multiple lamps 20*a*, 20*b*, 20*c*, 20*d*, 20*e* and 20*f*. Although track lighting system 10 is shown in the drawings to include six (6) lamps, the system may include a different plural number of lamps (e.g., 4 lamps, 10 lamps, 17 lamps, etc.). Each of these lamps is operatively connected to a support structure (such as a wall or ceiling, not shown) through a system track 30 hung from the support structure using multiple supports 24, 26 and 28 and canopies 52, 54 and 56, as illustratively shown in FIG. 1. It is noted that while FIG. 1 shows three supports 24, 26 and 28, the track may have a different number of supports, as well as canopies. Thus, FIG. 1 represents an exemplary track light system in accordance with the present invention, but the present invention is not limited specifically to the number of elements and components shown in the figures.

In accordance with the present invention, track lighting system 10 is designed to allow lighting levels of the lamps to be controlled in multiple ways. Track lighting system 10 is controllable by a wireless remote control 40 (or, for convenience, "wireless remote"). Wireless remote 40 includes a multiple number of buttons. In the exemplary schematic illustration shown in FIG. 1, wireless remote 40 is shown to include 8 buttons, but wireless remote may include a different number of buttons, such as 4 buttons, 10 buttons, etc. The exemplary wireless remote 40 in FIG. 1 shows control buttons 42*a*, 42*b*, 42*c*, 42*d*, 42*e* 42*f*, 44 and 46. Each button may be a distinct push-button type device or other suitable device, or may be represented graphically within a touch-sensitive type display that is capable of sensing a position of a contact with the sensor. Since push buttons and other mechanical components suitable for use within a remote control, and touch-sensitive type displays are well known, further description thereof is not provided herein except where necessary for an understanding of the present invention. Moreover, for purposes of describing the present invention, the term "button" as used herein shall include mechanical push-buttons, other types of buttons, switches, and non-mechanical interfaces that enable a user to control one or more lamps as herein described, including, but not limited to, a touch-sensitive display.

Wireless remote 40 includes dedicated control buttons 42*a*, 42*b*, 42*c*, 42*d*, 42*e* and 42*f* ("dedicated buttons"), each of which individually controls a respective lamp. That is, control button 42*a* controls the operation of lamp 20*a*, control button 42*b* controls the operation of lamp 20*b*, and so on. It is appreciated that the wireless remote may contain a different number of dedicated control buttons. For example, if the track contains 9 lamps, then the wireless remote would include 9 dedicated control buttons. As another example, if the track contains 4 lamps, then the wireless remote would include 4 dedicated control buttons. Hence, the present invention is not limited solely to a wireless remote having any specific number of control buttons.

Each of the dedicated control buttons, along with control circuitry to be described, controls the operation of a respective lamp to cycle through a multiple number of intensity levels. The system may include three intensity levels, such as high, medium, low, as well as off. The system may include four intensity levels, such as high, medium-high, medium-low, low, and then off. The system may include six intensity levels or another number of intensity levels (e.g., 5, 8, 10, etc.). Hence, the present invention is not limited to any specific number of intensity levels. For convenience, and only as an example, the system is described as having three intensity levels. With three levels, the dedicated control buttons operate as follows: (1) during an initial off-state of the lamp, depression of a respective control button causes the lamp to be set to its highest intensity level (i.e., "high level"); (2) depression of the control button while the lamp is at the high level causes that lamp to be set to a lower intensity level, such as a mid-level (or "medium level"); (3) depression of the control button while the lamp is at the mid-level causes that lamp to be set to an even lower intensity level (or "low level"); and (4) finally, depression of the control button while the lamp is at the low level causes the lamp to turn off ("off-state"). Hence, each depression of one of the dedicated control buttons 42*a*, 42*b*, 41*c*, 42*d*, 42*e* and 42*f* on remote control 40 causes the respectively controlled lamp to cycle through the intensity levels (e.g., initially in the off-state): high level-medium level-low level-off.

As stated above, the track lighting system of the present invention may control each of the lamps therein to be set to a different number of intensity levels (or states) than that described above. In any event, during operation of track lighting system 10 of the present invention, a user can selectively set the intensity of each of the lamps 20*a*, 20*b*, 20*c*, 20*d*, 20*e* and 20*f* as desired by depressing one or more times any of the dedicated control buttons 42*a*, 42*b*, 42*c*, 42*d*, 42*e* and 42*f*.

Wireless remote 40 also includes a control "ALL" button 44 (or, simply, the "ALL button 44", and also called "uniform control button") for uniformly controlling the intensity level of all of the lamps. Specifically, ALL button 44 allows a user to set all of the lamps to (in the example of where there are 3 intensity levels) a high state (i.e., high level), medium level, low level, or off state. In one version, depressing ALL button 44 causes the lights to cycle through the three different states then off (i.e., high, medium, low, off) independent of the current individual intensity level of any lamp. That is, depression of ALL button 44 initially causes all of the lamps to be set to the high level, subsequent depression of ALL button 44 then causes all of the lamps to be set to the medium level, subsequent depression of ALL button 44 then causes all of the lamps to be set to the low level; and subsequent depression of ALL button 44 then causes all of the lamps to be set to the off-state. Depression of any of the control buttons 42*a*, 42*b*, 42*c*, 42*d*, 42*e* and 42*f* to change one or more individual lamp settings after depression of ALL button 44 has no impact on how the lamps are universally controlled by a subsequent depression of ALL button 44. In another variation, a change of intensity of any lamp causes a subsequent depression of ALL button 44 to cause all of the lamps to be set to the high level. Hence, in such variation, to set all of the lamps to, for example, the low level, ALL button 44 is depressed three times in succession (without depressing another button between any one of the depressions of ALL button 44). Further, in each of these variations, a different number of intensity levels may be provided, as mentioned above, such as 5 levels, 7 levels, 8 levels, etc.

Wireless remote 40 includes a further control "Mem/Off" button 46 that causes each of the lamps 20*a*, 20*b*, 20*c*, 20*d*, 20*e* and 20*f* to be set to their respective previously set level (or "pre-set" level), as previously established by control buttons 42*a*, 42*b*, 42*c*, 42*d*, 42*e* and 42*f*. Specifically, as a user selectively sets one or more lamps to a respective desired level using any of the control buttons 42*a*, 42*b*, 42*c*, 42*d*, 42*e* and 42*f*, the intensity level(s) (i.e., high, mid, low, off) of the lamp(s) is stored in a memory (to be further described). Subsequent changes to the intensity level of a lamp via one of the control buttons 42*a*, 42*b*, 42*c*, 42*d*, 42*e* and 42*f* likewise is stored in memory (i.e., old pre-set levels are overwritten with the new pre-set levels). In a variation, the current states (i.e., levels) of the lamps are stored in memory only upon holding the ALL and Mem/Off buttons simultaneously for a predetermined amount of time (e.g., 3 second, 5 seconds, or another amount of time). In another variation, the levels of the lamps are stored in memory when the Mem/Off button is held down for at least 3 seconds (e.g., or 5 seconds or another amount of time). Preferably, the wireless remote includes an LED that flashes when the current levels of the lamps are stored in memory. In any of the described variations, the stored level of each lamps is called herein as the "pre-set" or "previously set" level of that lamp.

As mentioned above, Mem/Off button 46 (also called "pre-set level button") causes lamps 20*a*, 20*b*, 20*c*, 20*d*, 20*e* and 20*f* to be set to their previous (or pre-set) levels. In accordance with the present invention, depressing Mem/Off button 46 once causes all of the lamps to be set to their pre-set levels, and depressing Mem/Off button 46 twice in succession (e.g., within 3 seconds, or within 5 seconds, or within another amount of tiem) causes all of the lamps to be set to the high level, and depressing control button three times in succession turns all of the lamps off.

In a variation, depressing Mem/Off button 46 initially sets all of the lamps to their pre-set levels, and subsequent depressing of Mem/Off button 46 turns all of the lamps off. In such variation, the Mem/Off button 46 enables the user to simply and quickly turn on or change all of the lamps to the pre-set levels, and then enables the user to simply and quickly turn off all of the lamps. Advantageously, in this variation, depressing Mem/Off button 46 first causes the controller to ascertain the current settings of the lamps before changing the light level settings. If the current settings of the lamps are the same as those in memory, that is, the lamps are already at their pre-set levels, then the lamps are turned off. If, however, the lamp level settings are not the same as their pre-set levels, then the lamps will be set to those pre-set level.

During operation, a user can selectively set each lamp within track lighting system 10 of the present invention to a respective, desired level. For example, a user can set (using the dedicated control buttons) lamp 20*a* to the high level, lamp 20*b* to the medium level, lamp 20*c* to the low level, lamp 20*d* to the high level, lamp 20*e* to the off-state, and lamp 20*f* to the low level. Of course, the lamps can be set to different levels. Table 1 below is provided to identify the states of each of the lamps in this example.

TABLE 1

| | Individual Lamps | | | | | |
|---|---|---|---|---|---|---|
| | Lamp 20a | Lamp 20b | Lamp 20c | Lamp 20d | Lamp 20e | Lamp 20f |
| Intensity Level | High | Medium | Low | High | Off | Low |

The user subsequently may depress ALL button 44 one or more times to set all of the lamps to the high level, the medium level, the low level, or off. After changing the light settings using ALL button 44, as desired, the user subsequently can cause all of the lights to return to their pre-set state by depressing Mem/Off button 46 one time. For example, a user, after establishing desired pre-set levels of all of the lamps within the track lighting system 10 of the present invention, is able to turn off all of the lamps by depressing Mem/Off button 46 three times in succession or by depressing ALL button 44 four times, as already described. In the variation in which the Mem/Off button 46 alternates between the pre-set levels and off, the lamps may be turned off simply by depressing the Mem/Off button 46 once or twice, as needed. In another variation, the level cycling order of ALL button 44 is reversed as that described above so that turning off all of the lamps may be achieved by a single depression of ALL button 44. In yet a further variation, and as mentioned above, a different number of levels can be employed within track lighting system 10 of the present invention (e.g., high, medium-high, medium-low, low, off).

Given all of the control buttons within remote control 40 as described above, the lamps within track lighting system 10 of the present invention may be controlled in various novel manners, including selective control of individual lamps, universal control of all of the lamps, and one-touch control to set all of the lamps to their respective pre-set levels. Table 2 shown below provides an exemplary change of settings that may be achieved in accordance with the present invention, where the lamps' pre-set levels have already been established to the levels shown in Table 1 above and the lamps' initial states are at the respective pre-set levels.

TABLE 2

| Step | | Lamp 20a | Lamp 20b | Lamp 20c | Lamp 20d | Lamp 20e | Lamp 20f |
|---|---|---|---|---|---|---|---|
| 0 | Initial State | High | Medium | Low | High | Off | Low |
| 1 | Depress ALL Button 44 | High | High | High | High | High | High |
| 2 | Depress ALL Button 44 | Medium | Medium | Medium | Medium | Medium | Medium |
| 3 | Depress Button 46 | High | Medium | Low | High | Off | Low |
| 4 | Depress Button 46 3 times | Off | Off | Off | Off | Off | Off |
| 5 | Depress Button 46 | High | Medium | Low | High | Off | Low |

As shown in Table 2, initially (step 0) all of the lamps are at the respective pre-set levels. Such levels may be well suited to provide optimal lighting in areas of, for example, a living room so that various aesthetic and functional objectives are achieved. As an example, the lamps set to the high level provide ample reading light to areas of the room in which a person may desire to read a book while, at the same time, lamps set to lower levels (e.g., medium, low) are directed to other areas of the room that require lower lighting settings (e.g., to show artwork, etc.). Further, lamps may be established to have a pre-set level of off (e.g., lamp 20*a* in the example shown in Table 2) where such lamps ordinarily are off during normal usage of the room, but where it is still desired to be able to have such lamps be on during other (perhaps, less common) usage of the room. In any event, and in accordance with the present invention, the multiple lamps of the track lighting system 10 of the present invention are individually adjusted, both in lighting intensity and direction, in accordance with a user's individual desires and to suit the lighting needs, whether aesthetic, functional or both, of the room (or other facility) containing the track lighting system.

Next, it may be desired to establish a uniform lighting intensity of all of the lamps, and depressing ALL button 44 one time (step 1 in Table 2) causes all of the lamps 20*a*, 20*b*, 20*c*, 20*d*, 20*e* and 20*f* to be set to the high level. Similarly, it may be desired to establish a uniform, but lower light intensity, and depressing ALL button 44 a second time (step 2 in Table 2) achieves this goal. Thereafter, it may be desired to return the lighting intensities of the lamps to their original, pre-set levels, and depressing Mem/Off button 46 (step 3) achieves this desired state. The occupant of the room then may desire to turn off all of the lights (e.g., before vacating the room) and depresses Mem/Off button 46 three times in succession to do so (step 4). After a period of time, a person may return to the room and cause the lamps to again return to their preset levels by depressing Mem/Off button 46 (step 5). As illustrated from the foregoing described exemplary steps, the present invention enables users to control track lighting in ways that cannot be achieved by existing track lighting systems. Although not shown in Table 2, the pre-set level of one or more lamps may be modified (i.e., by using control buttons 42*a*, 42*b*, 42*c*, 42*d*, 42*e* and 42*f*) at any time, as desired.

Track lighting system 10 of the present invention also optionally may be controlled by an existing wall switch 12 to adjust lighting intensities of the lamps within the system. Track lighting system 10 of the present invention may be hardwired to a power source (e.g., house power) either with or without the inclusion of a master control switch (e.g., wall switch 12, generally located in the vicinity of where the track lighting system is installed). In the case of where track lighting system 10 is powered without use of a wall switch, the lamps are operated solely by remote control 40 in the manner described above. The present invention also allows for the inclusion of a wall switch so that the lamps may be controlled by either the wall switch 12 or remote control 40.

FIG. 1 shows track lighting system 10 employing wall switch 12. In such variation, power supplied to the track lighting system is supplied from a suitable power source through an ordinary wall switch 12 that operates in either an off (generally down) position or an on (generally up) position. When wall switch 12 is in its off position, no power is supplied to the lamps and thus all lamps are off. When wall switch 12 is moved to its on position, power is supplied to the track lighting system 10 of the present invention and, in accordance with the present invention, operates to cause all of the lamps to be set to their respective pre-set levels. Hence, the present invention advantageously enables a user to cause all of the lamps within the track lighting system of the present invention to be set to desired, pre-set levels by the single action of moving a wall switch to its on position.

Wall switch 12 then may be moved back to its off position thereby causing all of the lamps to turn off. However, while switch 12 is in its on position and in accordance with the present invention, switch 12 may be used to cause all of the lamps to be set to the high level by moving switch 12 to its off position and then back to its on position within a three second interval of time. Thus, the present invention further enables a user to quickly set all of the lamps to the high level, if desired.

From the foregoing description of the function of wall switch 12, it is seen that wall switch 12 causes the lamps to be controlled in a manner similar to how Mem/Off button 46 controls the lamps. Table 3 below shows how using wall switch 12 is similar to how Mem/Off button 46 is used.

TABLE 3

| Operation of Wall Switch 12 | Operation of Mem/Off Button 46 | Result |
|---|---|---|
| Off to On | Depress One Time | Lamps set to Respective Pre-Set Levels |
| On to Off to On within 3 Seconds | Depress Twice in Succession | All Lamps set to High Level |
| On to Off | Depress Three Times in Succession | All Lamps Off |

As schematically shown in FIG. 1, track lighting system 10 includes track 30. Track 30 provides support to lamps 20*a*, 20*b*, 20*c*, 20*d*, 20*e* and 20*f* and provides a conduit for power lines 22*a*, 22*b*, 22*c*, 22*d*, 22*e* and 22*f*. Power lines 22*a*, 22*b*, 22*c*, 22*d*, 22*e* and 22*f* provide power to lamps 20*a*, 20*b*, 20*c*, 20*d*, 20*e* and 20*f*.

Track lighting system 10 also includes controller 50 disposed within canopy 56. Controller 50 includes various circuitry that carry out the operations of track lighting system 10, as described herein. Specifically, controller 50 includes a wireless receiver, a light intensity controller and multiple power outputs. Furthermore, controller 50 may include storage (i.e., the "memory" mentioned above) for storing the pre-set levels of the lamps of track lighting system 10.

Figure 2:
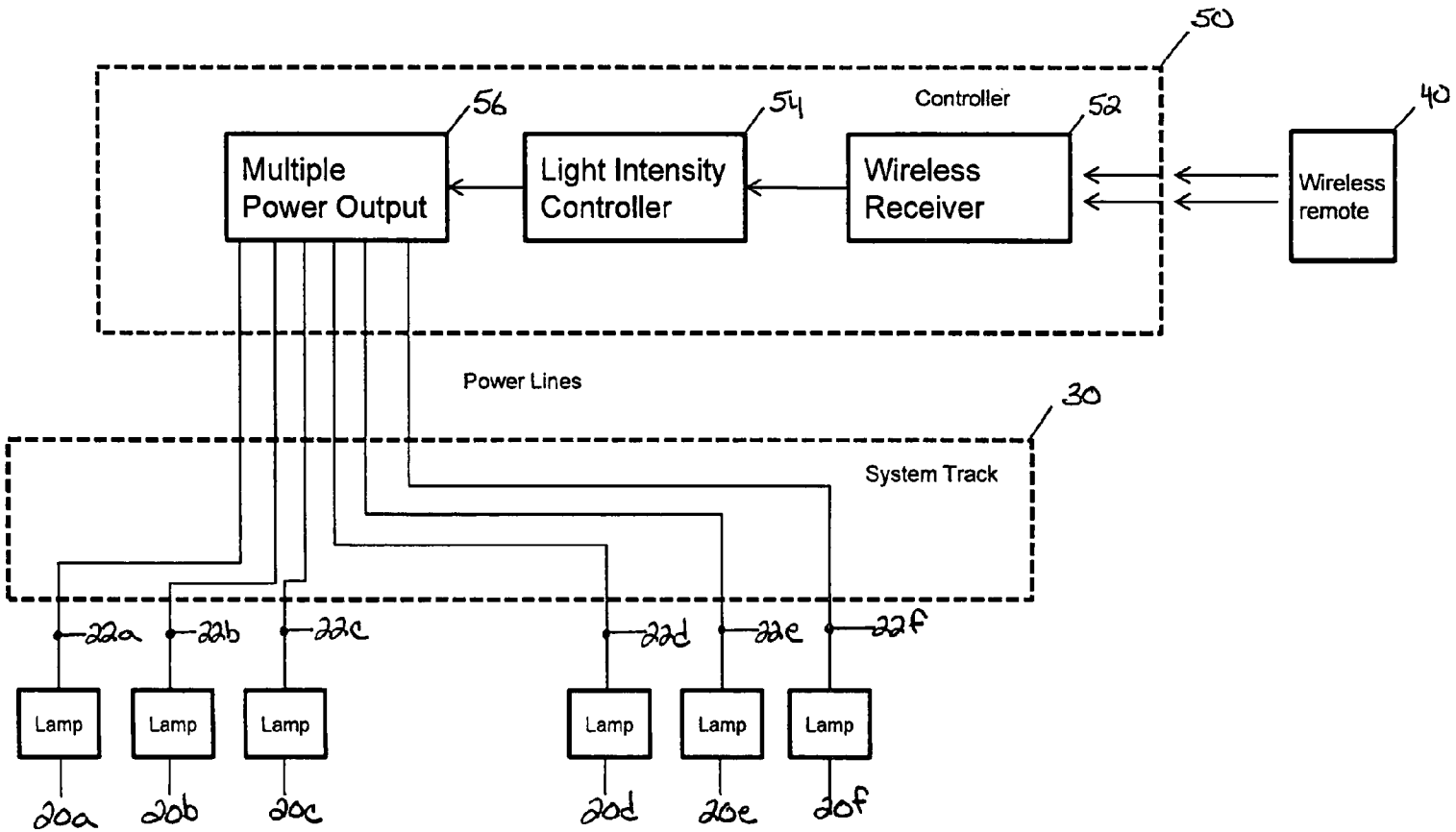
FIG. 2 is a functional block diagram of the remotely controllable track lighting system of the present invention.

FIG. 2 is a functional block diagram of track lighting system 10 of the present invention. As shown, controller 50 includes wireless receiver 52, a light intensity controller 54 and a multiple power output 56 (or, simply, "power output 56"). Wireless receiver 52 receives wirelessly transmitted signals supplied from wireless remote 40. Light intensity controller 54 controls (or adjusts) the power outputs supplied from power output 56 in accordance with the signals received from wireless remote 40. Such control is carried out in the manners previously described. Power output 56 provides an individual adjustable power output to each of the lamps 20*a*, 20*b*, 20*c*, 20*d*, 20*e* and 20*f*. It is appreciated that all of the functions of controller 50 may be implemented by a single component or multiple components and that the design of controller 50 having the functionality as herein described is within the ability of one of ordinary skill in the art. As such, further description of controller 50 and its various functional components, except where necessary for an understanding of the present invention, is not provided.

Wireless receiver 52 functions as a central receiver for wireless data transmitted by wireless remote 40. The received data transmission is processed by wireless receiver 52 and supplied to light intensity controller 54. The type and extent of processing carried out by wireless receiver 52 is dependent upon the structure and content of the signal transmitted by wireless remote 40. For example, the transmitted signal may include data identifying an individual lamp and a cycle "instruction" in order to cause controller 50 to control the identified lamp to change to the next intensity level in the cycle. As another example, the transmitted signal only identifies the button on the wireless remote that is depressed and controller 50 changes the intensity level of one or all of the lamps in a manner that depends on which button is depressed. In a further example, the transmitted signal includes data that identifies the intensity level of each lamp. As will be appreciated by those of ordinary skill in the art, wireless remote 40 may carry out various processing and also include storage in order to transmit a signal with the information provided in the above-examples. Other variations also are possible.

In both FIGS. 1 and 2, the track lighting system of the present invention is shown to include six (6) lamps 20*a*, 20*b*, 20*c*, 20*d*, 20*e* and 20*f*. In accordance with the present invention, power output 56 supplies power to each lamp through separate power lines 22*a*, 22*b*, 22*c*, 22*d*, 22*e* and 22*f*. Each of the power lines extends through system track 30 and terminates at and supplies power to a respective lamp. More specifically, power line 22*a* extends from controller 50 through system track 30 to lamp 20*a*, power line 22*b* extends from controller 50 through system track 30 to lamp 20*b* and so on. As also shown in FIG. 1, each power line 22*a*, 22*b*, 22*c*, 22*d*, 22*e* and 22*f* is sufficiently long so as to allow each lamp to be placed at a desired position along track 30. For example, lamp 20*a* as shown in FIG. 1 can be placed by an installer of the system at a position to the left or to the right of that shown in the figure. The other lamps shown in the figure also can be placed at various positions, as desired. In another variation, the lamp locations are fixed on the track and are not movable. Thus, the present invention pertains to a track having movable lamps and/or a track having non-movable lamps.

As previously mentioned, controller 50 includes memory for storing respective pre-set levels of each lamp. Such memory may be disposed within light intensity controller 54 or another functional element already described or may be a separate element altogether (as would be appreciated by those of ordinary skill in the art).

In accordance with another embodiment of the present invention, the wireless remote includes memory for storing pre-set intensity levels of the lamps, as well as additional processing capability. Such processing capability may be in the form of a dedicated processor that establishes (or modifies) the intensity level of each lamp based upon the particular button that is depressed and stores the modified intensity level(s) in internal memory for future use. For example, if a button is depressed to change the intensity level of one lamp to the next (e.g., lower) level in the cycle, then the wireless remote's processor ascertains the current level of that lamp, based on the data stored in internal memory and sets that level to the next level, and then stores the new level in memory. The wireless remote provides new intensity level data to the controller within the track canopy (also called "track controller"). The track controller in turn establishes the intensity level of each lamp in the manner previously described. In a variation, the wireless remote transmits data that identifies the intensity level of all of the lamps. Other variations are possible, and since the particular design of a wireless remote is within the ability of one of ordinary skill in the art given the description herein, further description thereof is not provided except where necessary for an understanding of the present invention.

Figure 3:
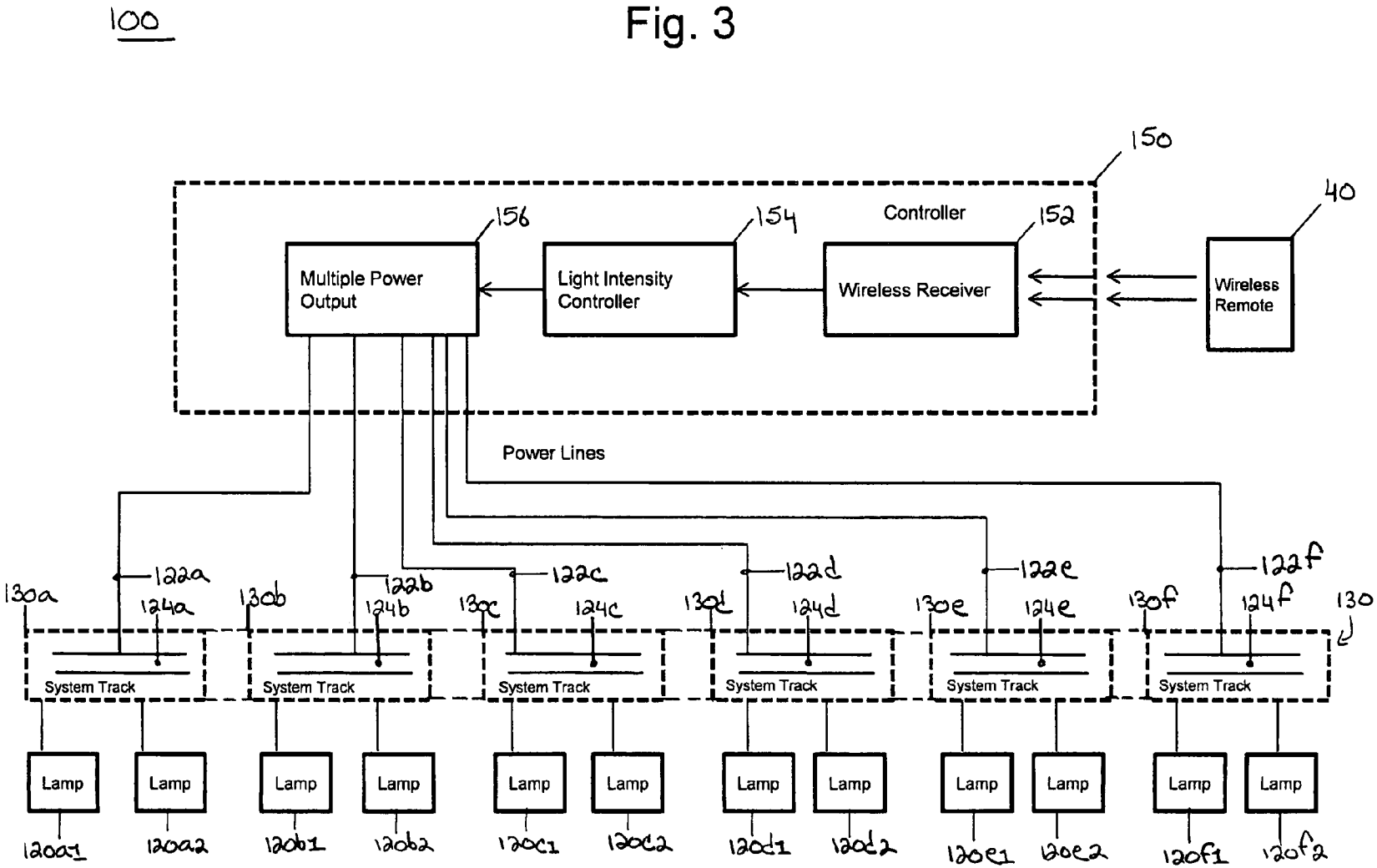
FIG. 3 is a functional block diagram of the remotely controllable track lighting system in accordance with another embodiment of the present invention.

FIG. 3 is a functional diagram of the track lighting system in accordance with a further embodiment of the present invention, in which the track is comprised of a multiple number of segmented track sections (to be described further below). As shown in FIG. 3, track lighting system 100 includes a set of lamps 120*a*1, 120*a*2, 120*b*1, 120*b*2, 120*c*1, 120*c*2, 120*d*1, 120*d*2, 120*e*1, 120*e*2, 120*f*1 and 102*f*2. It is noted that the particular number of lamps shown and described is only illustrative, and that another number of lamps may be employed. Track lighting system 100 also includes a system track 130, a wireless remote 140, and a controller 150. Wireless remote 140 and controller 150 operate respectively in the same manner as wireless remote 40 and controller 50 as previously described (and/or all variations thereof).

In accordance with the embodiment shown in FIG. 3, track 130 includes a multiple number of segmented track sections 130*a*, 130*b*, 130*c*, 130*d*, 130*e*, and 130*f*. In accordance with the present invention, each segmented track section (also called track segment herein) includes a respective pair of conductors extending along that section, where conductors of one track segment are electrically isolated from conductors of the other track segments. Likewise, a lamp installed on one track segment is powered by the conductors of that track segment, and a second lamp installed on a second track segment is powered by the conductors of that second track segment.

With reference to FIG. 3, track 130 is shown to include six (6) track segments 130*a*, 130*b*, 130*c*, 130*d*, 130*e*, and 130*f*, as mentioned above. As shown, track segment 130*a* contains a first conductor 124*a* (including hot and return), track segment 130*b* contains a second conductor 124*b*, track segment 130*c* contains a third conductor 124*c*, and so on. First conductor 124*a* is powered from multiple power output 156 via power line 122*a*, second conductor 124*b* is powered via power line 122*b*, and so on. Hence, each power line 122*a*, 122*b*, 122*c*, 122*d*, 122*e* and 122*f* supplies power respectively to conductors 124*a*, 124*b*, 124*c*, 124*d*, 124*e* and 124*f*. Power lines 122*a* through 122*f* preferably are hidden within track 130 and extend through various track segments, as needed. Then, each track segment separately powers the lamps that are installed thereon. As shown in illustrative FIG. 3, lamps 120*a*1 and 120*a*2 are installed on track segment 130*a* and are powered by the first conductor 124*a* and, thus, lamps 120*a*1 and 120*a*2 are powered by power line 122*a*. Likewise, lamps 120*b*1 and 120*b*2 are installed on track segment 130*b* and are powered by the second conductor 124*b* and, thus, lamps 12*ba*1 and 120*b*2 are powered by power line 122*b*. The same arrangement applies for the other lamps shown in the figure.

The lamps are controlled in the embodiment of FIG. 3 in a manner similar to that described in connection with the other embodiments described herein, except the dedicated buttons on wireless remote 140 (i.e., those corresponding to buttons 42*a*, 42*b* . . . 42*f*) control the power supplied to a track segment (and not necessarily to an individual lamp). Here, since two lamps are installed on each track segment, each dedicated button controls the two lamps that are installed on the track segment being controlled. Of course, a different number of lamps may be installed on each track segment. For example, a track segment may contain a single lamp, three lamps or another number of lamps. The other two buttons (i.e., corresponding to buttons 44 and 46 in FIG. 1) operate in the manner as previously described.

In each of the various embodiments, the present invention has been described and shown as a system with a single track of lights. The present invention is not limited to a single track and may encompass multiple tracks ("multi-track system"). Thus, and in accordance with yet another embodiment of the present invention, a track lighting system includes a first track of lights (e.g., having 6 lamps) powered by a first controller and a second track of lights (e.g., having 5 lamps) powered by a second controller. Each controller is similar to controller 50 (or controller 150). A single wireless remote (similar to wireless remote 40) is provided to control both tracks of lights. The wireless remote includes a set of dedicated buttons, with each dedicated button controlling a respective lamp (e.g., 11 dedicated buttons, one for each lamp of the two tracks). The wireless remote includes two additional buttons that operate in the same manner as buttons 44 and 46 in order to provide universal control of all of the lamps.

In a variation of the multi-track system, rather than providing a dedicated button for each lamp of both tracks, the wireless remote includes one or more buttons that enable the user to designate the particular track to control and includes a set of buttons that control each lamp within the designated track (e.g., 6 buttons, similar to buttons 42*a*-42*f*). The wireless remote includes two additional buttons that operate similarly to how buttons 44 and 46 operate, but universally control only the lamps of the designated track. In addition to, or instead of, such buttons, two buttons are provided to universally control all lamps on all of the tracks.

In the multi-track system, a single wireless remote may operatively control tracks of lamps disposed within different parts of a house, office or other facility, and advantageously control the intensity levels of individual lamps within each of those tracks. For the single track and multi-track systems described herein, and all variations thereof, the present invention provides users with increased convenience, flexibility, and customization with regard to lighting levels of lamps included within a track lighting system.

The present invention has been described in the context of a number of embodiments, a number of variations and examples thereof. It is to be understood, however, that other expedients known to those skilled in the art or disclosed herein may be employed without departing from the spirit of the invention.

What is claimed is:

1. A track lighting system, comprising:

a track adapted to be mounted to a support structure;

a plurality of lamps supported by the track, each of the lamps having a separate line for providing power and being supported on a different location of the track;

a wireless remote having a plurality of buttons and adapted to wirelessly transmit a control signal in accordance with depression of the buttons by a user of the wireless remote, the wireless remote including a dedicated processor, a memory, and a plurality of dedicated buttons, each of the dedicated buttons associated with a respective lamp supported by the track; and a single central controller coupled to the track and adapted to receive the control signal wirelessly transmitted by the wireless remote and to selectively provide power to separate lines to establish each of the lamps supported by the track to a respective intensity level in accordance with the received control signal, the controller being adapted to selectively change an intensity level of the lamp associated with the dedicated button of the wireless remote upon depression by a user.

2. The track lighting system of claim 1, wherein the controller is adapted to selectively cycle one of the lamps through a plurality of intensity levels upon multiple depressions of the respective dedicated button on the wireless remote associated with said one of the lamps.

3. A track lighting system, comprising:

a track adapted to be mounted to a support structure;

a plurality of lamps supported by the track, each of the lamps supported on a different location of the track;

a wireless remote having a plurality of buttons including a pre-set level button, and being adapted to wirelessly transmit a control signal in accordance with depression of the buttons by a user of the wireless remote;

a controller coupled to the track and adapted to receive the control signal wirelessly transmitted by the wireless remote and to selectively establish each of the lamps supported by the track to a respective intensity level in accordance with the received control signal, said controller further comprising memory for storing data identifying a previously set intensity level of each of the lamps;

the controller, upon depression by the user of the pre-set level button of the wireless remote, ascertaining current levels of all of the lamps and establishing all of the lamps to their respective previously set intensity levels if the current levels are different from the previously set intensity levels, and establishing all of the lamps to off if the current levels are the same as the previously set intensity levels.

4. A track lighting system as claimed in claim 3, further comprising said controller, upon receiving multiple signals within a predetermined length of time from said pre-set level button of said wireless remote, cycles between a plurality of said intensity levels of said lamps, said plurality of states comprising at least two of the following:

a first state in which all of said lamps are set to their respectively previously set intensity levels;

a second state in which all of said lamps are set to off;

a third state in which all of said lamps are set to their maximum intensity levels;

a fourth state in which all of said lamps are set to their initial intensity levels prior to the receipt of said multiple signals within said predetermined length of time from said pre-set level button of said wireless remote;

a fifth state in which all of said lamps are set to a previously-established default intensity level.

5. A track lighting system, comprising:

a track adapted to be mounted to a support structure, the track having a plurality of track segments, each of the track segments including a respective power conductor, each of the power conductors being electrically isolated from one another;

a plurality of lamps, each of the lamps supported by a select one of the track segments, and each of the lamps electrically coupled to the respective power conductor of the track segment supporting the respective lamp;

a wireless remote comprising a controller and having a plurality of buttons and adapted to wirelessly transmit a control signal in accordance with depression of the buttons by a user of the wireless remote; and a single controller coupled to the track and comprising a memory, said single controller controlling the intensity level of each said lamp, said single controller being adapted to receive the control signal wirelessly transmitted by the wireless remote and to selectively power each of the power conductors to a respective power level in accordance with the received control signal.

6. The track lighting system of claim 5, wherein each of the power conductors extends substantially along an entire length of the respective track segment.

7. The track lighting system of claim 5, wherein the controller is adapted to receive a source of power through a power switch switchable between an on position, in which power is supplied to the controller, and an off position, in which power is not supplied to the controller;

and the controller includes memory for storing data identifying a previously set power level of each of the power conductors, and the controller is adapted to establish each of the power conductors to their respective previously set power levels based on the data stored in the memory when power is initially received by the controller as a result of the power switch being moved from the off position to the on position.

8. The track lighting system of claim 5, wherein at least two of the lamps are supported by a same one of the track segments, and said at least two of the lamps are electrically coupled to the respective power conductor of said same one of the track segments.

* * * * *